United States Patent [19]

Kutrow

[11] Patent Number: 4,659,020

[45] Date of Patent: Apr. 21, 1987

[54] QUICK ADJUSTABLE SHATTER JET MECHANISM

[75] Inventor: James R. Kutrow, Clinton, Ohio

[73] Assignee: The Babcock & Wilcox Company, New Orleans, La.

[21] Appl. No.: 790,022

[22] Filed: Oct. 22, 1985

[51] Int. Cl.[4] ..... B05B 3/00; C21C 7/00

[52] U.S. Cl. ..... 239/752; 239/225.1; 239/265; 266/216; 422/185; 422/310; 422/207; 423/DIG. 3; 162/30.1

[58] Field of Search ..... 162/30.1, 30.11, 240; 422/168, 207, 185, 310; 266/215, 217, 218, 216, 219; 423/DIG. 3; 239/225, 389, 102, 265, 752, 225.1

[56] References Cited

U.S. PATENT DOCUMENTS

| | | | |
|---|---|---|---|
| 910,400 | 1/1909 | Lischer | 239/225 |
| 2,518,239 | 8/1950 | Leigh | 422/185 |
| 2,591,188 | 4/1952 | Nilsson | 422/185 |
| 2,967,758 | 1/1961 | Thorson | 423/DIG. 3 |
| 3,122,421 | 2/1964 | Gettle | 423/DIG. 3 |
| 3,194,650 | 7/1965 | Kurzinski | 266/216 |
| 3,877,643 | 4/1975 | Smith | 239/102 |
| 4,421,596 | 12/1983 | Högberg | 423/DIG. 3 |

*Primary Examiner*—Michael S. Marcus

*Attorney, Agent, or Firm*—Robert J. Edwards

[57] ABSTRACT

A readily adjustable shatter jet mechanism comprises a frame which rotatably and displaceably receives a fluid supply pipe assembly. The assembly includes a fluid supply pipe which is pivotally movable. A nozzle is connected to the pipe and can be rotated into one of a plurality of rotational positions. The assembly can be disengaged from the frame and reengaged with the frame at a different location so that the pipe and its nozzle can also be displaced with respect to the frame. In this way the fluid jet can be directed in a variety of directions toward a smelt stream to be broken up by the fluid jet.

9 Claims, 4 Drawing Figures

QUICK ADJUSTABLE SHATTER JET MECHANISM

FIELD AND BACKGROUND OF THE INVENTION

The present invention relates in general to smelt processing equipment, and in particular to a new and useful shatter jet mechanism for breaking a smelt stream.

Shatter jets are used on chemical recovery furnaces to shatter the smelt stream as it exits the furnace through the smelt opening and the smelt spout. The smelt stream must be shattered into droplet-size materials to prevent a smelt-water explosive reaction when contact is made with the green liquor in the dissolving tank. The shatter medium is usually steam although compressed air is occasionally used.

Shatter jet mechanisms consist of a horizontal pipe which may be rotated about its centerline axis with a tee section and nozzle or nozzles in the center, arranged so that directional control of the nozzle is accomplished by rotating the pipe. A length of pipe between the tee and the nozzle produces a fixed arc of nozzle positions usually maintained in a given position by a notched handle. Some shatter jets are arranged with the main pipe in a vertical position so that the nozzle has a horizontal arc.

The trajectory of the smelt stream as it flows off the end of the smelt spout is variable and depends on the volume of smelt flow, the smelt temperature and other operating conditions. Directional control of the shatter jet nozzle to meet the variable trajectory is important to assure the maximum efficiency in shattering the smelt stream into droplets.

Of equal importance is the directional control of the resultant shattered smelt droplets toward the opening in the dissolving tank. Impingement of the smelt droplets on adjacent surfaces should be avoided since the semi-cooled smelt has a tendency to stick to all surfaces and resuts in a buildup which must be manually removed. Large deposits may remain hot enough to cause an explosion when they are removed and fall into the dissolving tank.

U.S. Pat. No. 2,967,758 to Thornson discloses an apparatus for disintegrating and dispersing a molten smelt stream. Also see U.S. Pat. No. 3,122,421 to Gettle; U.S. Pat. No. 4,421,596 to Hogberg; U.S. Pat. No. 2,007,799 to Gloersen; and U.S. Pat. No. 4,280,982 to Shindome et al. All these references show the use of jets for breaking up a smelt stream.

U.S. Pat. No. 2,518,239 to Leigh is also relevant for showing a spray nozzle mounting and oscillating mechanism used in chemical recovery furnaces.

SUMMARY OF THE INVENTION

The present invention is drawn to a quick adjustable shatter jet mechanism for generating a jet to be directed against a smelt stream for shattering the smelt stream into small droplets.

According to the inventive mechanism, a shatter jet nozzle is supplied with a jet fluid through a pipe. The nozzle can be pivoted about the axis of the pipe and can also be repositioned forwardly and rearwardly into a plurality of different positions with respect to a smelt spout for supplying the smelt stream.

Accordingly an object of the present invention is to provide an adjustable shatter jet mechanism for supplying a fluid jet to shatter a smelt stream from a smelt spout, comprising a frame, a fluid supply pipe connected to said frame to form a fluid jet, a jet nozzle connected to said pipe for discharging a fluid jet from said pipe in a selected direction with respect to a smelt spout, nozzle rotation mounting means connected between said pipe and said frame for pivotally mounting said pipe to said frame for rotation about a longitudinal axis of said frame to change the selected direction of discharge from said nozzle, and pipe displacement means connected between said nozzle rotation mounting means and said frame for changing a position of said pipe on said frame in a direction toward and away from a smelt spout.

A further object of the present invention is to provide a shatter jet mechanism which generates a fluid jet whose direction can be adjusted both with respect to an angle of discharge and with respect to a spacing from the smelt stream.

A still further object of the invention is to provide a shatter jet mechanism which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and desriptive matter in which a preferred embodiment of the invention is illustrated.

DESCRIPTION OF THE PREFERRED EMBODIMENT

Figure 1:
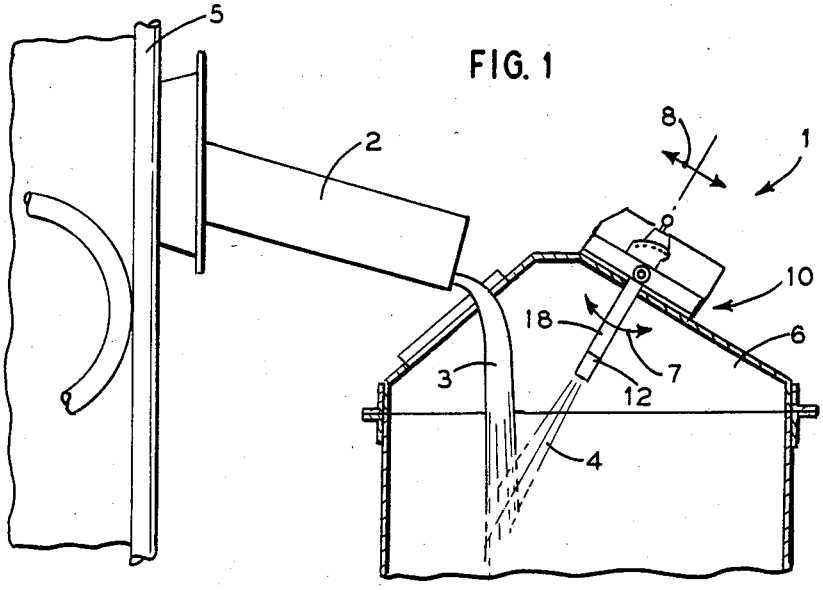
FIG. 1 is a side elevational view of the quick adjustable shatter jet mechanism according to the present invention in position for breaking up a smelt stream from a smelt spout.

Referring to FIG. 1 in particular, the invention embodied therein comprises a quickly adjustable shatter jet mechanism generally designated 1 which is used in conjunction with a smelt spout 2 mounted on a side wall 5 near the furnace bottom. A stream of smelt at 3 is discharged into a stream housing 6. The shatter jet mechanism 1 discharges a stream of fluid 4 for dispersing and breaking up the smelt stream 3 into small droplets.

Mechanism 1 includes a frame generally designated 10 which carries pipe 18 and a jet nozzle 12. According to the invention pipe 18 and jet nozzle 12 can be pivoted in the direction of arrow 7 for changing the direction of jet 4, and can also be displaced in the direction of arrow 8, toward and away from the spout 2. In this way, various relative positions between nozzle 12 and stream 3, can be achieved.

Figure 2:
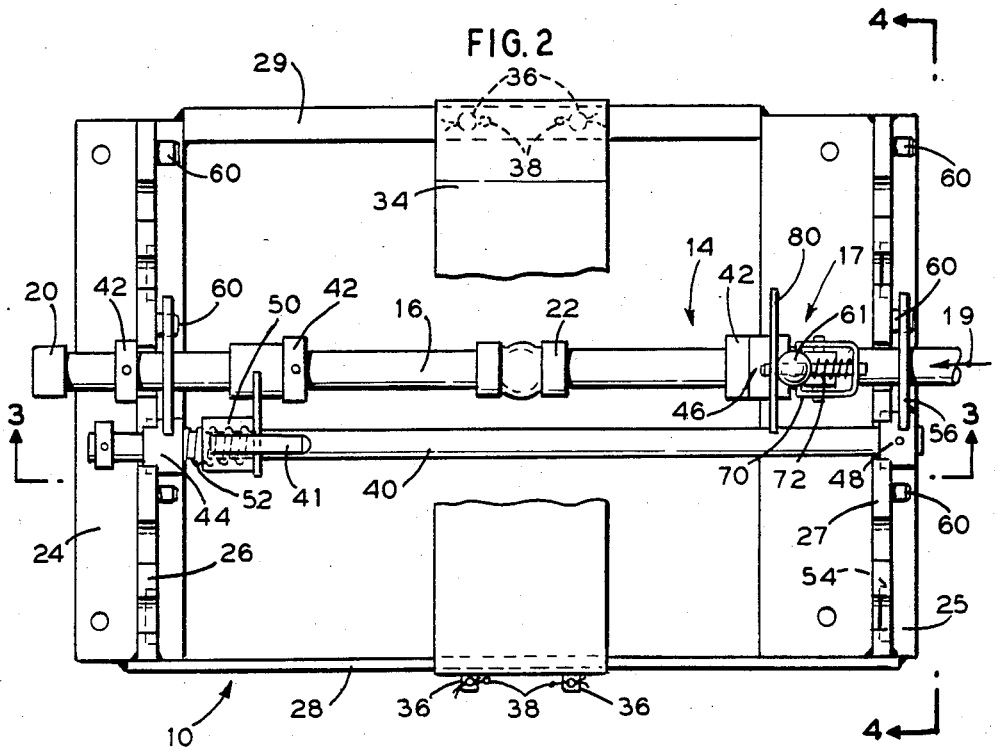
FIG. 2 is a top plan view of the inventive shatter jet mechanism.
Figure 3:
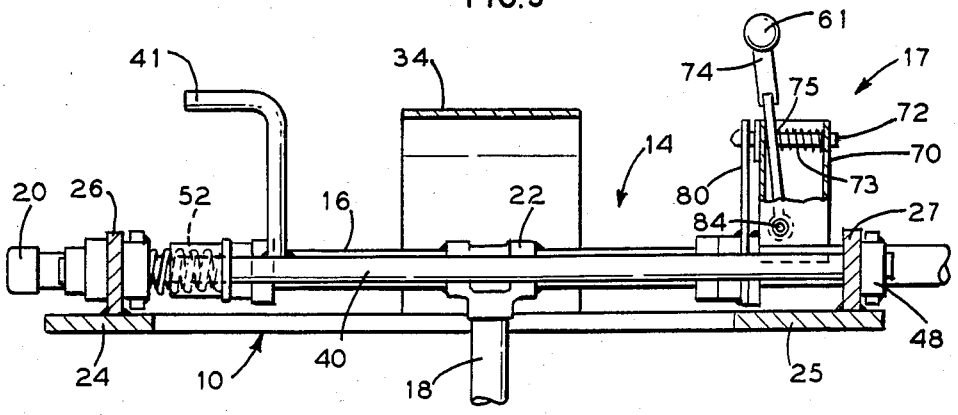
FIG. 3 is a view taken on line 3—3 of FIG. 2.
Figure 4:
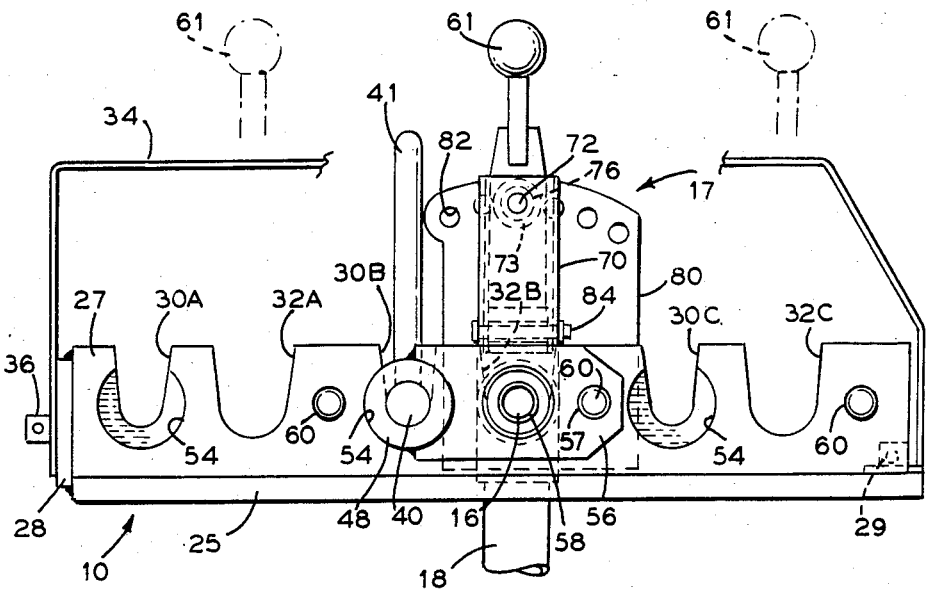
FIG. 4 is a view taken on line 4—4 of FIG. 2.

Referring now to FIGS. 2 through 4, the frame 10 of the inventive shatter jet mechanism 1 comprises a pair of T-shaped end sections 24 and 25 which each carry an upright plate 26 and 27, respectively. Each upright plate includes a plurality of recesses which are provided in pairs shown in FIG. 4 at 30A, 32A to 30C, 32C. A pipe assembly generally designated 14 is mounted in one pair of recesses, in this case recesses 30B, 32B as shown in FIG. 4. In accordance with the invention, pipe assembly 14 can be moved to any one of the three pairs of recesses for moving the pipe assembly in a direction of arrow 8 shown in FIG. 1. This effects a translation of the assembly 14 and thus the nozzle 12 toward or away from the spout 2.

End plates 24 and 25 are connected to each other by cross plates 28 and 29 which may for example be welded to plates 26 and 27. The central area of frame 10 as well as pipe assembly 14 is covered by a personnel safety cover member 34. Cover 34 is provided with two pairs of holes which are positioned to receive posts 36 which are fixed to cross plates 28 and 29. Cotter pins 38 are provided through the ends of posts 36 for retaining cover 34 on frame 10.

As shown in FIGS. 2 and 3, pipe assembly 14 comprises a fluid supply pipe 16 which can be supplied with fluid in the direction of arrow 19 through one open end of the pipe. The opposite end of pipe 16 is closed by cap 20. Pipe 16 can also be supplied with fluid in an opposite direction by reversing cap 20. Near the center of pipe 16 a tee connection 22 is provided which in turn is connected to pipe 18. Nozzle 12, shown in FIG. 1, is connected to the end of pipe 18 for generating jet 4. A plurality of rings 42 are fixed to pipe 16 and act to maintain the axial position of pipe assembly 14 on frame 10. In accordance with the invention, pipe 16 and the fittings and rings connected thereto are free for rotation about the longitudinal axis of the pipe.

The relative position between pipe 16 and frame 10 is maintained by pipe displacement means which include a cylindrical bar 40 which can be fixed in one of the slot pairs 30A, 30B or 30C, of frame 10. To facilitate the movement of assembly 14 from one set of recesses to the other, a handle 41 is welded onto bar 40.

Bar 40 carries bushings 44 and 48 which are fixed at respective ends to bar 40. A slidable bushing 50 is slidably engaged over bar 40 and includes a ring shaped end which bears against one of the rings 42 fixed to pipe 16. A spring 52 is engaged between an opposite end of bushing 50 and the bushing 44 for exerting a biasing force on bar 40 to the left as shown in FIGS. 2 and 3. This serves to firmly seat bushings 44 and 48 in circular indentations 54 of upright plates 26 and 27. These indentations are shown at 54 in FIG. 4 for receiving bushing 48. Also visible in FIGS. 2 and 4 is a bushing plate 56 which is welded to bushing 48 and which includes a bore 58 for rotatably and slidably receiving pipe 16 (shown in FIG. 4).

To avoid rotation of bar 40, plate 27 is provided with pins 60 which are insertable into hole or bore 57 provided in plate 56. Each of the recess pairs 30A, 32A through 30C, 32C, is provided with its own pin 60 for insertion in hole 57.

To change the position of assembly 14 on frame 10, an operator grasps handle 41 and a handle ball 61. Bar 40 is pushed to the right with reference to FIGS. 2 and 3, against the force of spring 52. This disengages bushings 44 and 48 from their respective indentation 54 and permits the assembly 14 to be lifted from one of the recess pairs of the upright plates 26 and 27, and to be replaced into another one of the pairs for moving the assembly 14 closer to or further from the spout 2.

Ball handle 61 forms part of a nozzle rotating mounting mechanism generally designated 17 for rotating nozzle 12 in the direction of arrow 7 shown in FIG. 1. Rotation mounting mechanism 17 comprises a box frame 70 which is welded to pipe 16. A catch pin 72 is axially movable in box 70 against the bias of spring 73. Opposite holes are provided in box 70 for holding pin 72 in its correct axial position. Ball 61 is connected to an actuating arm 74 which has a hole 76 therein shown in FIG. 4. Pin 72 is engaged in hole 76 and spring 73 bears between arm 74 and a washer 75 connected on pin 72. In this way handle 61 can be pivoted to the right as shown in FIG. 3 to also move pin 72 to the right.

Mechanism 17 also includes a rotation plate 80. Rotation plate 80 includes a plurality of holes 82 one of which can receive the free end of pin 72. Arm 74 is pivotally mounted to box 70 on a pivot shaft 84 so that pin 72 can be selectively inserted in one of the holes 82. Since box 70 is fixed to pipe 16, rotation of the box 70 causes rotation of pipe 16 and thus movement of nozzle 12 in the direction of arrow 7.

While a specific embodiment of the invention has been shown and described in detail to illustrate the application of the principles of the invention, it will be understood that the invention may be embodied otherwise without departing from such principles.

What is claimed is:

1. An adjustable shatter jet mechanism for supplying a fluid jet to shatter a smelt stream from a smelt spout, comprising:

a frame;

a fluid supply pipe for carrying fluid to form a fluid jet, carried by said frame;

a jet nozzle connected in fluid communication to said pipe for discharge of a fluid jet from the pipe in a selected direction;

nozzle rotation mounting means connected to said pipe for pivoting said pipe relative to said frame for rotation about a longitudinal axis of said pipe for changing the selected discharge direction of said nozzle;

pipe displacement means connected to said mounting means and mounted to said frame for changing a relative position between said pipe and said frame in a direction toward and away from a smelt spout whose smelt stream is to be shattered by the fluid jet to further change said selected discharge direction; and 'wherein said pipe displacement means comprises a bar extending parallel to said pipe and mounted to said frame, a plurality of bushings connected to said bar and including sliding bushing means for rotatably and slidably receiving said pipe, and wherein said nozzle rotation means comprises a handle connected to said pipe for rotating said pipe in said sliding bushings means.

2. A mechanism according to claim 1, wherein said pipe displacement means comprises a plurality of sets of recesses defined in said frame each for receiving said pipe and said bar, and means for fixing said pipe and bar to one of said sets of recesses.

3. A mechanism according to claim 2, wherein said means for fixing the position of said pipe and bar comprise said frame including circular indentations for receiving at least one of said bushings fixed to said bar and a spring for biasing said one bushing into said indentation.

4. A mechanism according to claim 3, wherein said sliding bushing means includes sliding bushing slidably mounted on said bar for rotatably receiving said pipe and a stop ring fixed to said pipe and bearing against said slidable bushing and against a biasing force of said spring.

5. A mechanism according to claim 1, including a tee connection connected at an intermediate location on said pipe, and a further pipe connected to said first mentioned pipe and carrying said nozzle, said further pipe extending radially from said first mentioned pipe and said selected direction for said nozzle always being radial with respect to said first mentioned pipe, said displacement means changing a position of said first mentioned pipe with respect to said frame in a direction radially of said first mentioned pipe.

6. A mechanism according to claim 5, including cover extending over said tee connection, said cover being connected to said frame.

7. A mechanism according to claim 5, wherein said nozzle rotation mounting means comprises a box member fixed to said pipe for rotation with said pipe, a handle arm rotatably mounted to said box connection, a catch pin axially movable in said box member and movable by said handle arm, a catch pin plate having a plurality of holes for selectively receiving said catch pin and being fixed with respect to said pipe displacement means for establishing different rotational positions of said pipe with respect to said pipe displacement means.

8. A mechanism according to claim 7, wherein said pipe displacement means comprises a bar connected to said frame and extending parallel to said pipe, a plurality of bushings connected to said bar for rotatably receiving said pipe and means for disconnecting said pipe and bar from said frame.

9. A mechanism according to claim 8, wherein said pipe displacement means includes a plurality of sets of recesses in said frame each for receiving said pipe and bar.

* * * * *